US010668722B2

(12) United States Patent
Bakker et al.

(10) Patent No.: US 10,668,722 B2
(45) **Date of Patent: *Jun. 2, 2020**

(54) PRINTHEAD EMPLOYING DATA PACKETS INCLUDING ADDRESS DATA

(71) Applicant: HEWLETT-PACKARD DEVELOPMENT COMPANY, L.P., Fort Collins, CO (US)

(72) Inventors: Chris Bakker, Aguadilla, PR (US); Eric Martin, Corvallis, OR (US); Adam L Ghozeil, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/397,448

(22) Filed: Apr. 29, 2019

(65) Prior Publication Data

US 2019/0248134 A1 Aug. 15, 2019

Related U.S. Application Data

(63) Continuation of application No. 16/156,950, filed on Oct. 10, 2018, now Pat. No. 10,343,396, which is a (Continued)

(51) Int. Cl.

| | |
|---|---|
| ***B41J 2/045*** | (2006.01) |
| ***B41J 2/175*** | (2006.01) |
| ***B41J 2/18*** | (2006.01) |

(52) U.S. Cl.

CPC ..... *B41J 2/04588* (2013.01); *B41J 2/0455* (2013.01); *B41J 2/0458* (2013.01); (Continued)

(58) Field of Classification Search

CPC B41J 2/04541; B41J 2/04588; B41J 2/04543; B41J 2/0455; B41J 2/07

(Continued)

(56) References Cited

U.S. PATENT DOCUMENTS

| | | | |
|---|---|---|---|
| 6,471,320 | B2 | 10/2002 | Anderson |
| 6,478,396 | B1 | 11/2002 | Schloeman et al. |

(Continued)

FOREIGN PATENT DOCUMENTS

| | | |
|---|---|---|
| JP | 2003072074 | 3/2003 |
| JP | 2003144662 | 5/2003 |

(Continued)

*Primary Examiner* — An H Do

(74) *Attorney, Agent, or Firm* — Dicke, Billig & Czaja, PLLC

(57) ABSTRACT

A printhead includes an address line, data lines, a fire pulse line, and a plurality of primitives, each primitive corresponding to a different data line and including a plurality of activation devices, each activation device corresponding to a different address of a set of addresses. A buffer receives data packets, each data packet including address data representative of an address of the set of addresses and print data for each primitive corresponding to the address. For each data packet, the buffer directs the address data to address logic and places the print data on the respective data line, and the address logic encodes the address represented by the address data onto the address line. For each primitive, the activation device corresponding to the address on the address bus activates a corresponding primitive function based on the corresponding print data when a fire pulse is present on the fire pulse line.

17 Claims, 11 Drawing Sheets

Related U.S. Application Data continuation of application No. 15/673,051, filed on Aug. 9, 2017, now Pat. No. 10,118,387, which is a continuation of application No. 15/544,053, filed as application No. PCT/US2015/015916 on Feb. 13, 2015, now Pat. No. 10,315,417.

(52) U.S. Cl.
CPC ..... *B41J 2/04541* (2013.01); *B41J 2/04581* (2013.01); *B41J 2/04585* (2013.01); *B41J 2/175* (2013.01); *B41J 2/17546* (2013.01); *B41J 2/18* (2013.01)

(58) Field of Classification Search
USPC ..... 347/9–12
See application file for complete search history.

(56) References Cited

U.S. PATENT DOCUMENTS

| | | | |
|---|---|---|---|
| 6,776,544 | B2 | 8/2004 | Jauert |
| 7,125,090 | B1 | 10/2006 | Silverbrook |
| 7,384,113 | B2 | 6/2008 | Benjamin et al. |
| 7,497,536 | B2 | 3/2009 | Benjamin |
| 7,794,057 | B2 | 9/2010 | Benjamin et al. |
| 7,959,246 | B2 | 6/2011 | Hamasaki et al. |
| 8,540,348 | B2 | 9/2013 | Benjamin |
| 8,770,685 | B2 | 7/2014 | Shepherd et al. |
| 10,118,387 | B2 | 11/2018 | Bakker |
| 10,343,396 | B2 * | 7/2019 | Bakker ..... B41J 2/04585 |
| 2002/0186265 | A1 | 12/2002 | Schloeman et al. |
| 2003/0081028 | A1 | 5/2003 | Fienn et al. |
| 2005/0104934 | A1 | 5/2005 | Cleland et al. |
| 2009/0033695 | A1 | 2/2009 | Burton |
| 2009/0160898 | A1 | 6/2009 | Bergstedt |
| 2011/0018917 | A1 | 1/2011 | Fujisawa et al. |

FOREIGN PATENT DOCUMENTS

| | | |
|---|---|---|
| JP | 2003159802 | 6/2003 |
| JP | 2004122757 | 4/2004 |
| JP | 2007185949 | 7/2007 |
| JP | 2013544678 | 12/2013 |
| JP | 2018505077 | 2/2018 |

* cited by examiner

210

| | MCLK CYCLE NO. | DATA | |
|---|---|---|---|
| | | RISE | FALL |
| 212 HEADER | 1 | START | — |
| | 2 | START | — |
| | 3 | START | — |
| | 4 | SYNC | — |
| 216 PRINT DATA | 5 | P(1) | P(2) |
| | 6 | P(3) | P(4) |
| | 7 | P(5) | P(6) |
| | • • • | • • • | • • • |
| 214 FOOTER | # | P(M- 1) | P(M) |
| | # | STOP | — |
| | # | STOP | — |
| | # | STOP | — |

Fig. 6

310

| | MCLK CYCLE NO. | DATA | |
|---|---|---|---|
| | | RISE | FALL |
| 212 HEADER | 1 | START | — |
| | 2 | START | — |
| | 3 | START | — |
| | 4 | SYNC | — |
| 320 ADDRESS DATA | 5 | PGR_ADD[3] | PGL_ADD[3] |
| | 6 | PGR_ADD[2] | PGL_ADD[2] |
| | 7 | PGR_ADD[1] | PGL_ADD[1] |
| | 8 | PGR_ADD[0] | PGL_ADD[0] |
| 216 PRINT DATA | 9 | P(1) | P(2) |
| | 10 | P(3) | P(4) |
| | 11 | P(5) | P(6) |
| | • • • | • • • | • • • |
| | # | P(M- 1) | P(M) |
| 214 FOOTER | # | STOP | — |
| | # | STOP | — |
| | # | STOP | — |

Fig. 8

PRINTHEAD EMPLOYING DATA PACKETS INCLUDING ADDRESS DATA

CROSS-REFERENCE TO RELATED APPLICATIONS

This patent application is a Continuation of U.S. application Ser. No. 15/673,051, now U.S. patent application Ser. No. 10/118,387, Issued Nov. 6, 2018 which is a Continuation of U.S. application Ser. No. 15/544,053, which entered National Stage Jul. 12, 2017 based on PCT/US2015/015916, filed Feb. 13, 2015 all of which are incorporated by reference herein.

BACKGROUND

Inkjet printers typically employ printheads having multiple nozzles which are grouped together into primitives, with each primitive typically having a same number of nozzles, such as 8 or 12 nozzles, for example. While each primitive of a group is coupled to a separate data line, all primitives of a group are coupled to a same address line, with each nozzle in a primitive being controlled by a corresponding address. The printhead successively cycles through the addresses of each nozzle in a repeating fashion such that only one nozzle is operated in each primitive at a given time.

BRIEF DESCRIPTION OF THE DRAWINGS

FIG. 6 is a block diagram illustrating generally an example of a print data packet for printhead.

FIG. 8 is a block diagram illustrating generally an example of a print data packet including address data according to one example.

DETAILED DESCRIPTION

In the following detailed description, reference is made to the accompanying drawings which form a part hereof, and in which is shown by way of illustration specific examples in which the disclosure may be practiced. It is to be understood that other examples may be utilized and structural or logical changes may be made without departing from the scope of the present disclosure. The following detailed description, therefore, is not to be taken in a limiting sense, and the scope of the present disclosure is defined by the appended claims. It is to be understood that features of the various examples described herein may be combined, in part or whole, with each other, unless specifically noted otherwise.

Figure 1:
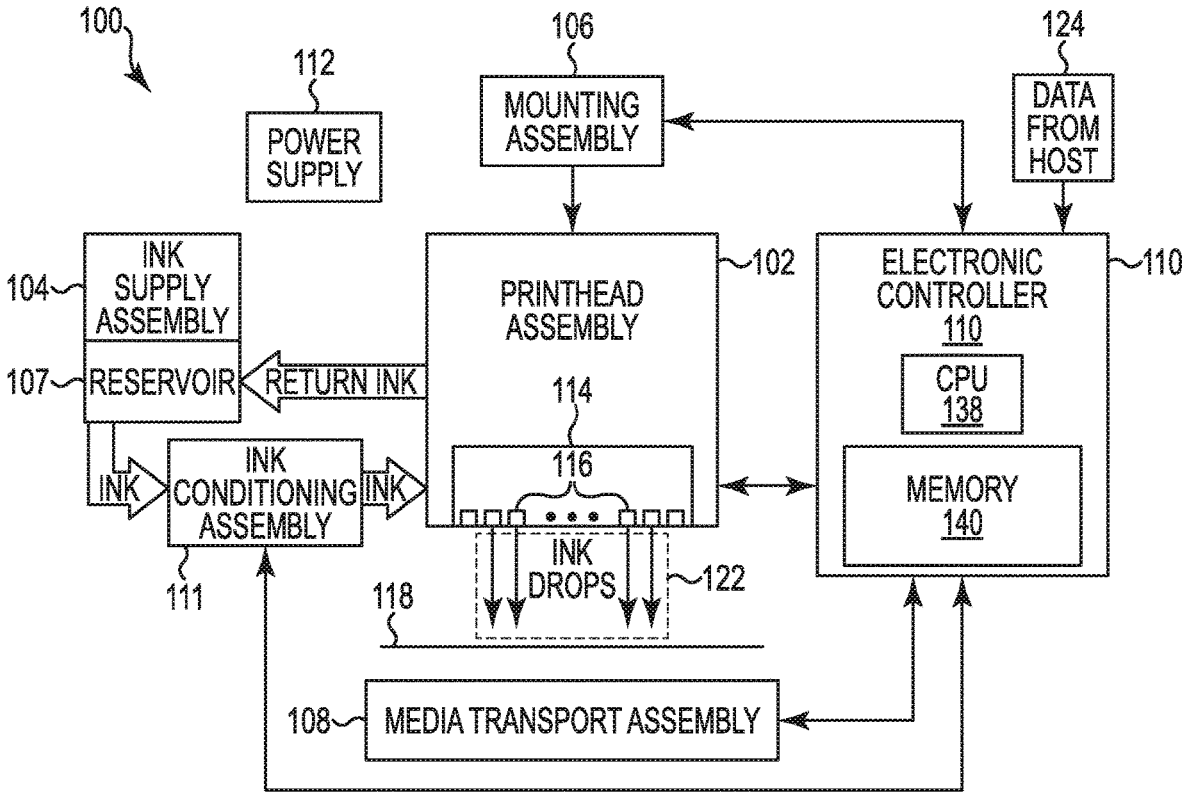
FIG. 1 is a block and schematic diagram illustrating an inkjet printing system including a fluid ejection device employing print data packets with embedded address data, according to one example.

FIG. 1 is a block and schematic diagram illustrating generally an inkjet printing system 100 including a fluid ejection device, such as a fluid drop ejecting printhead 102, employing print data packets, in accordance with the present disclosure, which include address data corresponding to different primitive functions within printhead 102 (e.g., drop generator (nozzle) actuation, recirculation pump activation). Including address data in print data packets, in accordance with the present disclosure, enables different duty cycles for different primitive functions (e.g., drop generators operated at higher frequency than recirculation pumps), enables the order in which drop generators are operated to be modified, and enables improved data rate efficiencies.

Inkjet printing system 100 includes an inkjet printhead assembly 102, an ink supply assembly 104 including an ink storage reservoir 107, a mounting assembly 106, a media transport assembly 108, an electronic controller 110, and at least one power supply 112 that provides power to the various electrical components of inkjet printing system 100.

Inkjet printhead assembly 102 includes at least one fluid ejection assembly 114 that ejects drops of ink through a plurality of orifices or nozzles 116 toward print media 118 so as to print onto print media 118. According to one example, fluid ejection assembly 114 is implemented as a fluid drop jetting printhead 114. Printhead 114 includes nozzles 116, which are typically arranged in one or more columns or arrays, with groups of nozzles being organized to form primitives, and primitives arranged into primitive groups. Properly sequenced ejections of ink drops from nozzles 116 result in characters, symbols or other graphics or images being printed on print media 118 as inkjet printhead assembly 102 and print media 118 are moved relative to one another.

Although described herein primarily with regard to inkjet printing system 100, which is disclosed as a drop-on-demand thermal inkjet printing system with a thermal inkjet (TIJ) printhead 114, the inclusion or embedding of address data within print data packets, according to the present disclosure, can be implemented in other printhead types as well, such wide array of TIJ printheads 114 and piezoelectric type printheads, for example. Furthermore, the embedding of address data within print data packets, in accordance with the present disclosure, is not limited to inkjet printing devices, but may be applied to any digital dispensing device, including 2D and 3D printheads, for example.

Figure 2:
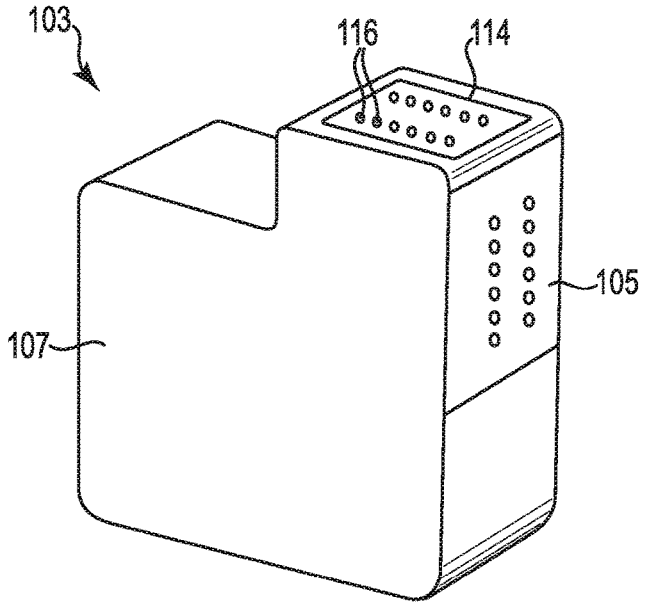
FIG. 2 is a perspective view of an example inkjet cartridge including a fluid ejection device employing print data packets with embedded address data according to one example

As illustrated by FIG. 2, in one implementation, inkjet printhead assembly 102 and ink supply assembly 104, including ink storage reservoir 105, are housed together in a replaceable device, such as an integrated inkjet printhead cartridge 103. FIG. 2 is a perspective view illustrating inkjet printhead cartridge 103 including printhead assembly 102 and ink supply assembly 104, including ink reservoir 107, with printhead assembly 102 further including one or more printheads 114 having nozzles 116 and employing print data packet including address data, according to one example of the present disclosure. In one example, ink reservoir 107 stores one color of ink, while in other examples, ink reservoir 107 may have include a number of reservoirs each storing a different color of ink. In addition to one or more printheads 114, inkjet cartridge 103 includes electrical contacts 105 for communicating electrical signals between electronic controller 110 and other electrical components of inkjet printing system 100 for controlling various functions including, for example, the ejection of ink drops via nozzles 116.

Referencing FIG. 1, in operation, ink typically flows from reservoir 107 to inkjet printhead assembly 102, with ink supply assembly 104 and inkjet printhead assembly 102 forming either a one-way ink delivery system or a recirculating ink delivery system. In a one-way ink delivery system, all of the ink supplied to inkjet printhead assembly 102 is consumed during printing. However, in a recirculating ink delivery system, only a portion of the ink supplied to printhead assembly 102 is consumed during printing, with ink not consumed during printing being returned to supply assembly 104. Reservoir 107 may be removed, replaced, and/or refilled.

In one example, ink supply assembly 104 supplies ink under positive pressure through an ink conditioning assembly 11 to inkjet printhead assembly 102 via an interface connection, such as a supply tube. Ink supply assembly includes, for example, a reservoir, pumps, and pressure regulators. Conditioning in the ink conditioning assembly may include filtering, pre-heating, pressure surge absorption, and degassing, for example. Ink is drawn under negative pressure from printhead assembly 102 to the ink supply assembly 104. The pressure difference between an inlet and an outlet to printhead assembly 102 is selected to achieve correct backpressure at nozzles 116, and is typically a negative pressure between negative 1 and negative 10 of H20.

Mounting assembly 106 positions inkjet printhead assembly 102 relative to media transport assembly 108, and media transport assembly 108 positions print media 118 relative to inkjet printhead assembly 102, so that a print zone 122 is defined adjacent to nozzles 116 in an area between inkjet printhead assembly 102 and print media 118. In one example, inkjet printhead assembly 102 is scanning type printhead assembly. According to such example, mounting assembly 106 includes a carriage from moving inkjet printhead assembly 102 relative to media transport assembly 108 to scan printhead 114 across printer media 118. In another example, inkjet printhead assembly 102 is a non-scanning type printhead assembly. According to such example, mounting assembly 106 maintains inkjet printhead assembly 102 at a fixed position relative to media transport assembly 108, with media transport assembly 108 positioning print media 118 relative to inkjet printhead assembly 102.

Electronic controller 110 includes a processor (CPU) 138, a memory 140, firmware, software, and other electronics for communicating with and controlling inkjet printhead assembly 102, mounting assembly 106, and media transport assembly 108. Memory 140 can include volatile (e.g. RAM) and nonvolatile (e.g. ROM, hard disk, floppy disk, CD-ROM, etc.) memory components including computer/processor readable media that provide for storage of computer/processor executable coded instructions, data structures, program modules, and other data for inkjet printing system 100.

Electronic controller 110 receives data 124 from a host system, such as a computer, and temporarily stores data 124 in a memory. Typically, data 124 is sent to inkjet printing system 100 along an electronic, infrared, optical, or other information transfer path. Data 124 represents, for example, a document and/or file to be printed. As such, data 124 forms a print job for inkjet printing system 100 and includes one or more print job commands and/or command parameters.

In one implementation, electronic controller 110 controls inkjet printhead assembly 102 for ejection of ink drops from nozzles 116 of printheads 114. Electronic controller 110 defines a pattern of ejected ink drops to be ejected from nozzles 116 and which, together, form characters, symbols, and/or other graphics or images on print media 118 based on the print job commands and/or command parameters from data 124. In one example of the present disclosure, as will be described in greater detail below, electronic controller 110 provides data, in the form of print data packets, to printhead assembly 102 which result in nozzles 114 ejecting the defined pattern of ink drops to form the desired graphic or image on print media 118. In one example, according to the present disclosure, the print data packets include address data and print data, with the address data representing primitive functions (e.g. drop ejection via drop generating elements, recirculation pump actuation), and the print data being data for the corresponding primitive function. In one example, the data packets may be received by electronic controller 110 as data 124 from a host device (e.g., a print driver on a computer).

Figure 3:
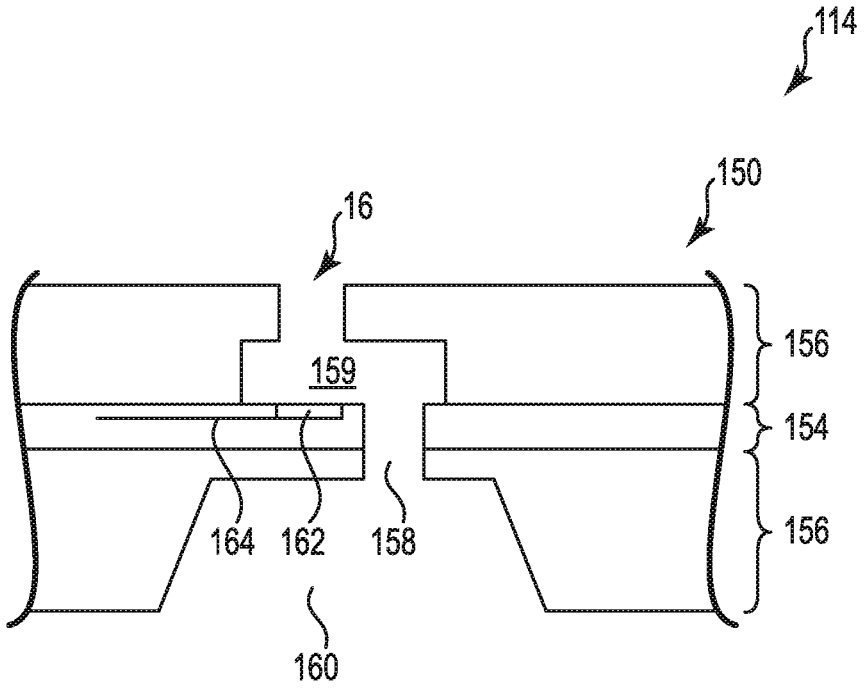
FIG. 3 is a schematic diagram generally illustrating drop generator, according to one example.

FIG. 3 is schematic diagram showing a portion of printhead 114 illustrating an example of a drop generator 150. Drop generator 150 is formed on a substrate 152 of printhead assembly 114 which has an ink feed slot 160 formed therein which provides a supply of liquid ink to drop generator 150. Drop generator 150 further includes a thin-film structure 154 and an orifice layer 156 disposed on substrate 152. Thin-film structure 154 includes an ink feed channel 158 and a vaporization chamber 159 formed therein, with ink feed channel 158 communicating with ink feed slot 160 and vaporization chamber 159. Nozzle 16 extends through orifice layer 154 to vaporization chamber 159. A heater or firing resistor 162 is disposed below vaporization chamber 159 and is electrically coupled by a lead 164 to control circuitry which control the application of electrical current to firing resistor 162 for the generation of ink droplets according to a defined drop pattern for forming an image on print media 118 (see FIG. 1).

During printing, ink flows from ink feed slot 160 to vaporization chamber 159 via ink feed channel 158. Nozzle 16 is operatively associated with firing resistor 162 such that a droplet of ink is ejected from nozzle 16 and toward a print medium, such as print medium 118, upon energization of firing resistor 162.

Figure 4:
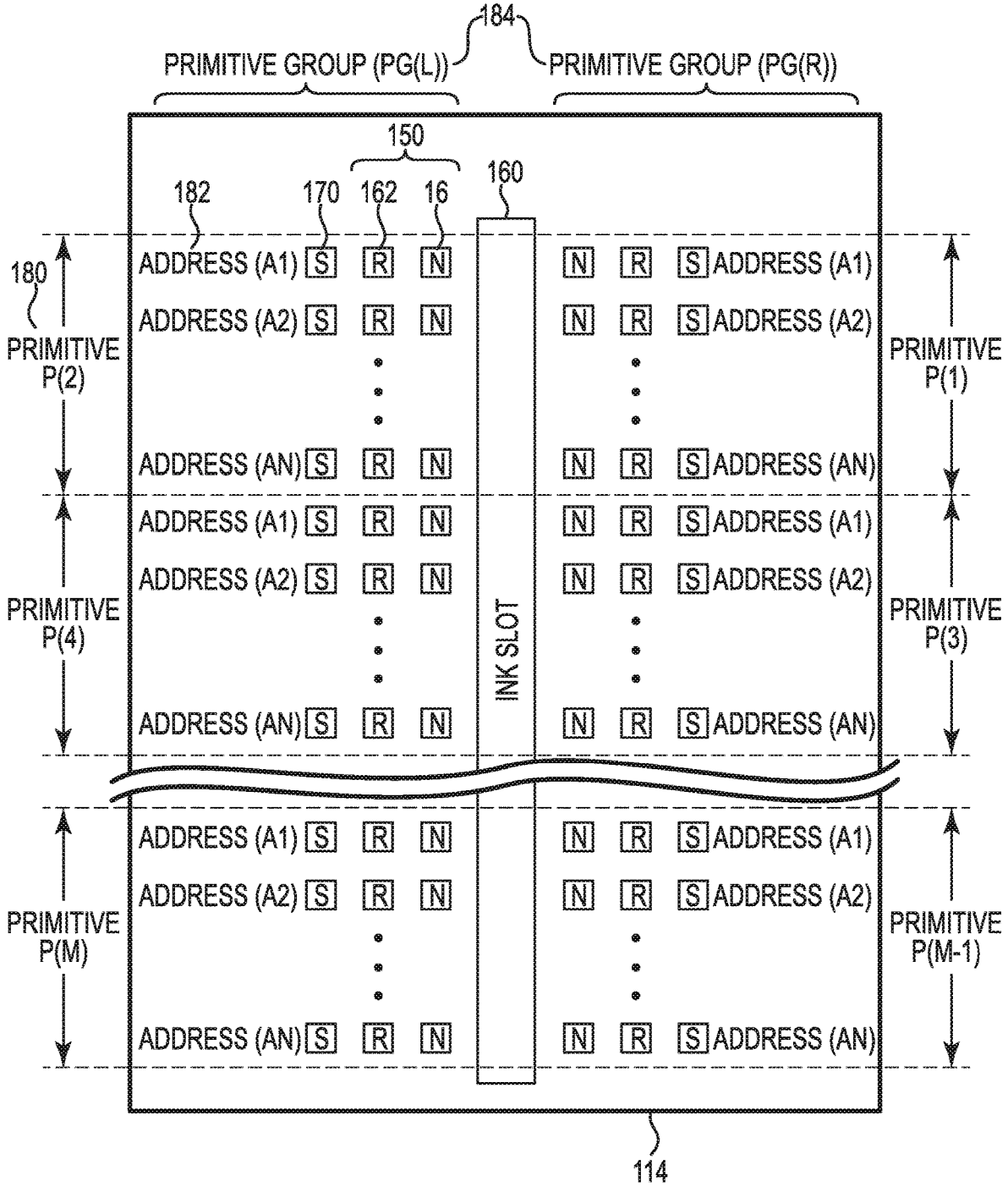
FIG. 4 is a block and schematic diagram illustrating generally a printhead having switches and resistors organized in primitives, according to one example.

FIG. 4 is a block and schematic diagram generally illustrating a typical drop ejecting printhead 114, according to one example, and which can be configured for use with data packets including address data in accordance with the present disclosure. Printhead 114 includes a number of drop generators 150, each including a nozzle 16 and a firing resistor 162 which are disposed in columns on each side of an ink slot 160 (see FIG. 3). An activation device, such as a switch 170 (e.g., a field effect transistor (FET)), corresponds to each drop generator 150. In one example, switches 170 and their corresponding drop generators 150 are organized into primitives 180, with each primitive including a number of switches 170 and corresponding drop generators 150. In the example of FIG. 4, switches 170 and corresponding drop generators 150 are organized into "M" primitives 180, with even-numbered primitives P(2) through P(M) disposed on the left-side of ink slot 160 and odd-numbered primitives P(1) through P(M−1) disposed on the right-side of ink slot 160. In the example of FIG. 4, each primitive 180 includes "N" switches 170 and corresponding drop generators 150, where N is an integer value (e.g. N=8). Although illustrated as each having the same number N of switches 170 and drop generators 150, it is noted that the number of switches 170 and drop generators 150 can vary from primitive to primitive.

In each primitive 180, each switch 170, and thus its corresponding drop generator 150, corresponds to a different address 182 of a set of N addresses, illustrated as addresses (A1) to (AN), so that, as described below, each switch 170 and corresponding drop generator 150 can be separately controlled within the primitive 180. The same set of N addresses 182, (A1) to (AN), is employed for each primitive 180.

In one example, primitives 180 are further organized in primitive groups 184. As illustrated, primitives 180 are formed into two primitive groups, a primitive group PG(L) including primitives 180 on the left-hand side of ink slot 160, and a primitive group PG(R) including primitives 180 on the right-hand side of ink slot 160, such that primitive groups PG(L) and PG(R) each have M/2 primitives 180.

In the illustrated example of FIG. 4, each switch 170 corresponds to a drop generator 150, which is configured to perform the primitive function of ejecting ink drops onto a print medium. However, switch 170 and its corresponding address 182 can also correspond to other primitive functions. For instance, according to one example, in lieu of corresponding to drop generators 150, one or more switches 170 can correspond to a recirculation pump which performs the primitive function of recirculating ink from ink slot 160. In one example, for instance, switch 170 corresponding to address (A1) of primitive P(2) may correspond to a drop generator that is disposed on printhead 114 in place of drop generator 150.

Figure 5:
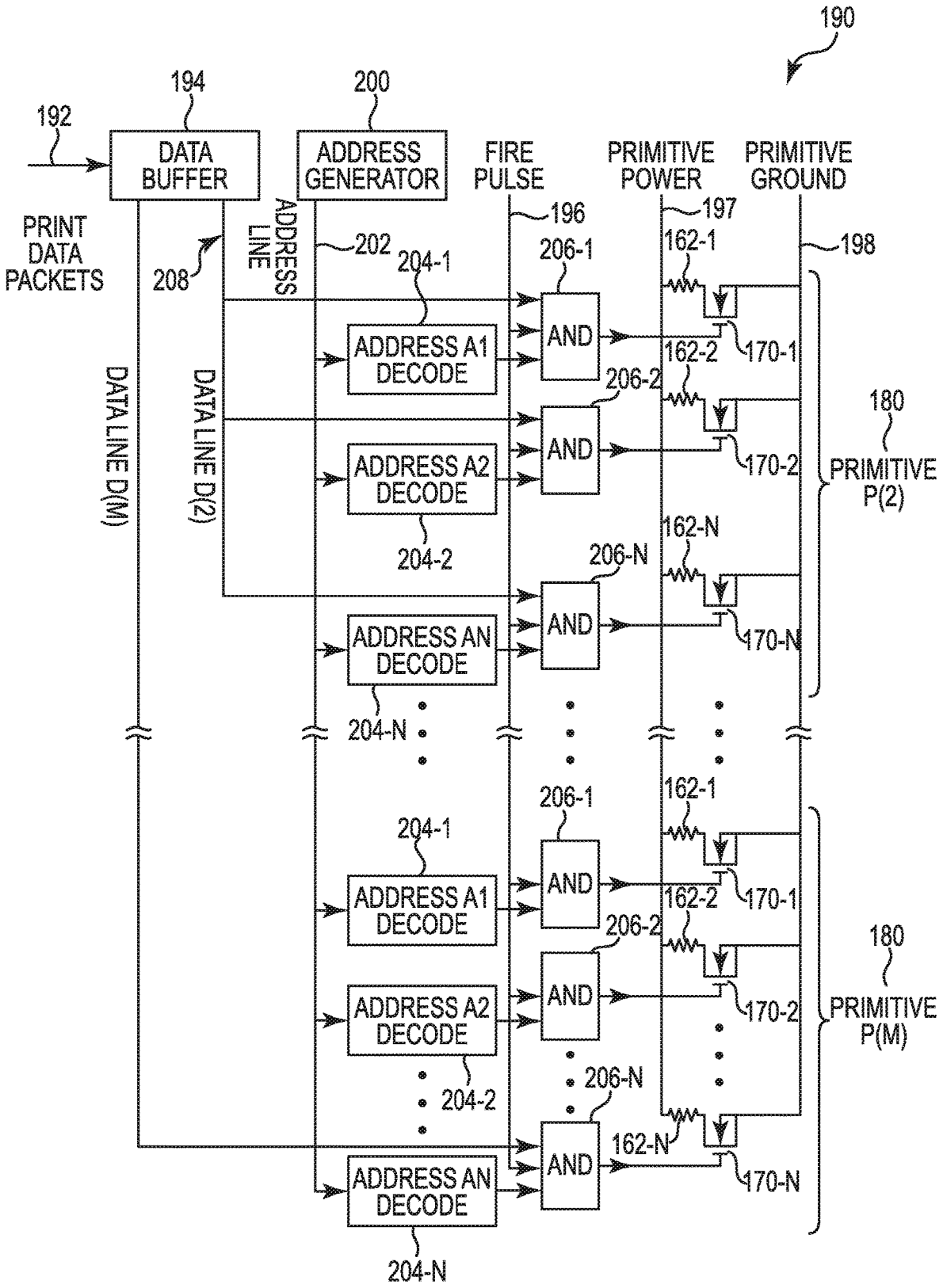
FIG. 5 is a block and schematic diagram illustrating generally an example of portions of primitive drive and control logic circuitry of a printhead.

FIG. 5 generally illustrates portions of primitive drive and logic circuitry 190 for printhead 114 according to one example. Print data packets are received by data buffer 192 on a path 194, a fire pulse is received on a patch 196, primitive power is received on a path 197, and primitive ground on a ground line 198. An address generator 200 sequentially generates and places addresses (A1) to (AN) on address line 202 which is coupled to each switch 170 in each primitive 180 via corresponding address decoders 204 and AND-gates 206. Data buffer 194 provides corresponding print data to primitives 180 via data lines 208, with one data line corresponding to each primitive 180 and coupled to corresponding AND-gate 206 (e.g., data line D(2) corresponding to primitive P(2), data line D(M) corresponding to primitive P(M)).

Primitive drive and logic circuitry 190 combines print data on data lines D(2) to D(M) with address data on address line 202 and the fire pulse on path 196 to sequentially switch electrical current from primitive power line 197 through firing resistors 170-1 to 170-N of each primitive 180. The print data on data lines 208 represents the characters, symbols, and/or other graphics or images to be printed.

Address generator 200 generates the N address values, A1 to AN, which control the sequence of in which firing resistors 170 are energized in each primitive 180. Address generator 200 repeatedly generates and cycles through all N address values in a fixed order so that all N firing resistors 170 can be fired, but so that only a single firing resistor 170 can be energized in each primitive 180 at a given time. The fixed order in which the N address values are generated can be in orders other than sequentially from A1 to AN in order to disperse heat across printhead 114, for example, but whatever the order, the fixed order is the same for each successive cycle. In one example, where N=8, the fixed order may be addresses A1, A5, A3, A7, A2, A6, A4, and A8. Print data provided on data lines 208 (D(2) to D(M)) for each primitive 180 is synced with the fixed order in which address generator 200 cycles through address values A1 to AN so that the print data is provided to the corresponding drop generator 150.

In the example of FIG. 5, the address provided on address line 202 by address generator 200 is an encoded address. The encoded address on address line 202 is provided to the N address decoders 204 of each primitive 180, with the address decoders 204 providing an active output to the corresponding AND-gate 206 if the address on address line 202 corresponds to the address of the given address decoder 204. For example, if the encoded address placed on address line 202 by address generator represents address A2, address decoders 204-2 of each primitive 180 will provide and active output to corresponding AND-gate 206-2.

AND-gates 206-1 to 206-N of each primitive 180 receive the outputs from corresponding address decoders 204-1 to 204-N and the data bits from the data line 208 corresponding to their respective primitive 180. AND-gates 206-1 to 206-N of each primitive 180 also receive the fire pulse from fire pulse path 196. The outputs of AND-gates 206-1 to 206-N of each primitive 180 are respectively coupled to the control gate of the corresponding switch 170-1 to 170-N (e.g. FETs 170). Thus, for each AND-gate 206, if print data is present on the corresponding data line 208, the fire pulse on line 196 is active, and the address on address line 202 matches that of the corresponding address decoder 204, the AND-gate 206 activates its output and closes the corresponding switch 170, thereby energizing the corresponding resistor 162 and vaporizing ink in nozzle chamber 159 and ejecting an ink drop from associated nozzle 16 (see FIG. 3).

FIG. 6 is a schematic diagram illustrating generally an example of a print data packet 210 employed with the primitive drive and logic circuitry 190 for printhead 114 as illustrated by FIG. 5. Data packet 210 includes a header portion 212, a footer portion 214, and a print data portion 216. Header portion 212 includes bits, such as start and sync bits, which are read into data buffer 194 on a rising edge of clock (MCLK), while footer 214 includes bits, such as stop bits, which are read into data buffer 194 on a falling edge of clock MCLK.

Print data portion 216 includes data bits for primitives P(1) through P(M), with the data bits for primitives P(1) to P(M−1) of right-hand primitive group PG(R) being read into data buffer 194 on the rising edge of clock MCLK and the data bits for primitives P(2) to P(M) of left-hand primitive group being read into data buffer 194 on the falling edge of clock MCLK. Note that FIG. 5 illustrates only a portion of primitive drive and logic circuitry 190 that corresponds to the left-hand primitive group PG(L) of FIG. 4, but that a similar drive and logic circuitry is employed right-hand primitive group PG(R) which receives print data via data buffer 194. Because address generator 200 of primitive drive and logic circuitry 190 of FIG. 5 (for both left- and right-hand primitive groups PG(L) and PG(R)) repeatedly generates and cycles through the N addresses, A1 to AN, a fixed order, the data bits of the print data portion 216 of data packet 210 must be in the proper order so as to be received by data buffer 194 and placed on data lines 218 (D(2) to D(M)) in the order that corresponds with the encoded address being generated on address line 202 by address generator 200. If data packet 210 is not synced with the encoded address on address line 202, the data will be provided to the incorrect drop ejecting device 150 and the resulting drop pattern will not produce the desired printed image.

Figure 7:
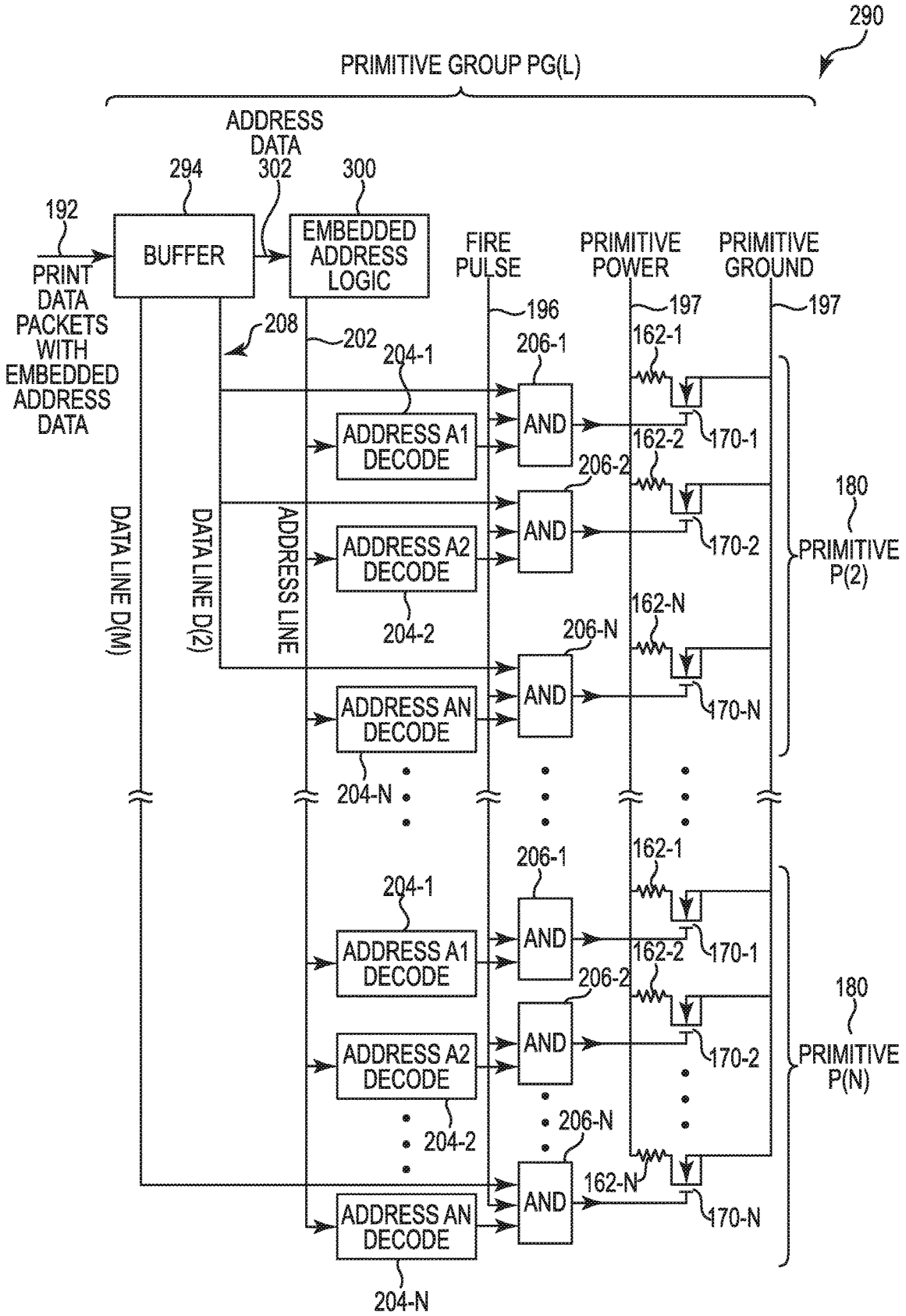
FIG. 7 is a block and schematic diagram illustrating generally an example of portions of primitive drive and control logic circuitry of a printhead employing print data packets with embedded address data, according to one example.

FIGS. 7 and 8 below respectively illustrate examples of primitive drive and logic circuitry 290 and print data packet 310 for employing print data packets including address data embedded therein along with print data, according to examples of the present disclosure. It is noted that the same labels are employed in FIGS. 7 and 8 to describe features similar to those described of FIGS. 5 and 6.

With reference to FIG. 8, print data packet 310, in addition to a header 212, a footer 214, and a print data portion 216, further includes an address data portion 320 containing address bits representing the address of the primitive functions (e.g. drop ejecting elements 150) within printhead 114 to which the print data bits within the print data portion 216 are to be directed. In the illustrated example of FIG. 8, 4-address bits are employed to represent the N addresses, A1 to AN, of primitive drive and logic circuit 290 of FIG. 7. With 4-address bits, N can have a maximum value of 16. In the example primitive drive logic circuit 290 of FIG. 7, if N=8 (meaning that each primitive 180 has 8 distinct addresses), only 3-address bit are required to for address data portion 320 of print data packet 310.

As illustrated, address bits PGR_ADD[0] to PGR_ADD [3] corresponding to right-side primitive group PG(R) are read into a data buffer 294 (FIG. 8) on a rising edge of clock MCLK, and address bits PGL_ADD[0] to PGL_ADD[3] are read into buffer 294 on a falling edge of clock MCLK. Similarly, print data bits P(1) to P(M−1) associated with address bits PGR_ADD[0] to PGR_ADD[3] of right-side primitive group PG(R) are read into data buffer 294 on a rising edge of clock MCLK, and print data bits P(2) to P(M) associated with address bits PGL_ADD[0] to PGL_ADD[3] of left-side primitive group PG(R) are read into data buffer 294 on a falling edge of clock MCLK.

With reference to FIG. 7, in contrast to primitive drive and logic circuitry 190 of FIG. 5, primitive drive and logic circuitry 290, according to one example of the present disclosure, a buffer 294 receives print data packets 310 on path 194, wherein the print data packets 310, in addition to a print data portion 216 further includes an address data portion 320 contain address bits representing the address of the primitive functions (e.g. drop ejecting elements 150) within printhead 114 to which the data bits within the print data portion 216 are to be directed. Buffer 294 directs the address bits of print data packet 310 to embedded address logic 300 and places the data bits from the print data portion 216 of print data packet 310 onto the corresponding data lines D(2) to D(M). Again, please note that FIG. 7 illustrates a portion of primitive drive and logic circuitry 290 corresponding to left-hand primitive group PG(L) of FIG. 4.

Embedded address logic 300, based on the address bit from the address data portion 320 of print data packet 310 received from buffer 294 encodes the corresponding address on address line 202. In direct contrast to address generator 200 employed by primitive drive and logic circuitry 190 of FIG. 5, which generates and places encoded addresses for all N addresses on address line 202 in a fixed order and in a repeating cycle, embedded address logic 300 places encoded address on address line 202 in the order in which the addresses are received via print data packets 310. As such, the order in which the encoded addresses are placed on address line 202 by embedded address logic 300 is not fixed and can vary such that different addresses and, thus the primitive function corresponding to the addresses, can have different duty cycles.

Additionally, by embedding address bits in address data portion 320 of print data packet 310, according to present disclosure, not only can the order in which encoded addresses are placed on address line 202 be varied (i.e., is not in a fixed cyclic order), but an address can be "skipped" (i.e., not encoded on address line 202) if there is no print data corresponding to the address. In such a case, a print data packet 320 will simply not be provided for such address for printhead 114.

For example, with reference to FIG. 4, consider a scenario where each primitive has 8 drop generators (i.e., N=8), and where drop generators 105 on printhead 114 are of alternating sizes, such that for each primitive 180, drop generators 150 corresponding to addresses A(2), A(4), A(6), and A(8) eject large ink drops relative to drop generators corresponding to address A(1), A(3), A(5), and A(7). Further, consider a print mode where only drop generators 150 corresponding to addresses A(2), A(4), A(6), and A(8) eject large ink drops are required to eject ink drops in the given print mode. Such a scenario is depicted by FIGS. 9 and 10 below.

Figure 9:
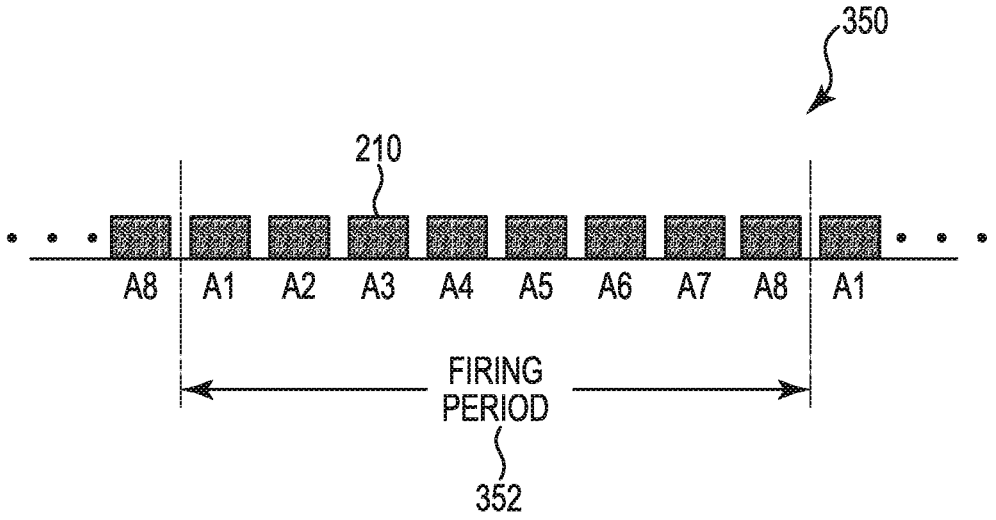
FIG. 9 is a schematic diagram illustrating generally a print data stream of print data packets for a printhead.

FIG. 9 is a schematic diagram illustrating generally a print data stream 350 for the above described scenario when employing primitive drive and control logic circuitry 190 of FIG. 5 and print data packet 210 of FIG. 6. Because address generator 200 is hard-wired to generate and place encoded addresses for all N addresses (N=8 in this scenario) on address line 202 in a fixed order, even though "small" drop generators will not be firing according to the print mode of the illustrative scenario, data packets 210 must be provided for addresses A1, A3, A5, and A7 corresponding to "small" drop generators 150 and cycled through primitive drive and control logic circuitry 190 along with data packets for addresses A2, A4, A6, and A8 "large" drop generators This scenario is illustrated in FIG. 9, where print data stream 350 includes a data packet 210 corresponding to each of the addresses A1 to A8, even though the "large" drop generators 150 associated with primitive addresses A2, A4, A6, and A8 will be the only drop generators firing. The time required for data packets 210 of data stream 350 to cycle through all addresses of the primitive, in this case addresses A1 to A8, is referred to as a firing period, as indicated at 352. Because address generator 200 generates and places encoded addresses for all N addresses (in this case, N=8) on address line 202 in a fixed order and in a repeating cycle, the duration of firing period 352 is of a fixed length for printhead 114 employing primitive drive and control logic circuitry 190 and print data packets 210.

Figure 10:
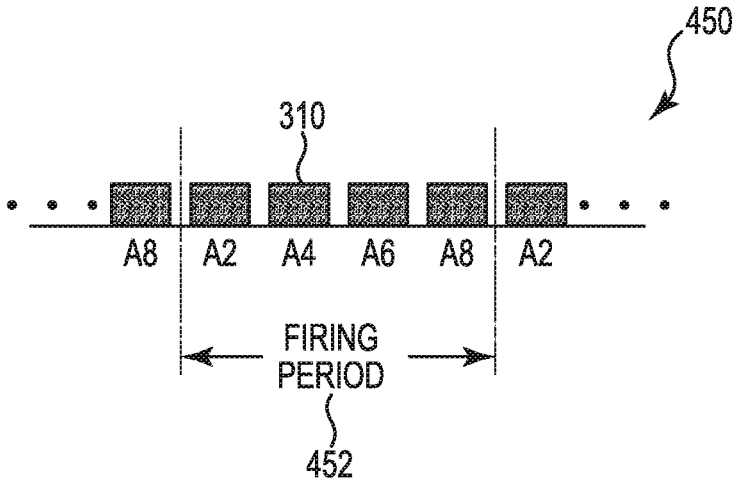
FIG. 10 is a schematic diagram illustrating generally a print data stream employing print data packets including address data according to one example.

In contrast, FIG. 10 illustrates a print data stream 450 for the illustrative scenario, where print data stream includes a data packet 310 only for addresses A2, A4, A6, and A8 corresponding to the large volume drop generators 150 which are being fired according to the given print mode. As a result, the duration of the firing period 452 is of a much shorter duration for printhead 114 employing primitive drive and control logic circuitry 290 and print data packets 310, according to the present disclosure, which employ embedded address data in print data packets 310. This shorter duration, in-turn, increases the print rate of printing system 100 for various print modes.

The ability of printhead 114 employing primitive drive and control logic circuitry 290 and print data packets 310, according to the present disclosure, to address and assign print data to selected addresses enables different primitive functions to be operated at different duty cycles. For example, with reference to FIG. 4, if each address A1 of each primitive 180 of printhead 114 is configured as a recirculation pump in lieu of a drop generator, such recirculation pump can be activated at a much lower duty cycle (frequency) than drop generators 150. For example, a recirculation pump at address A1 may only be addressed every other firing period 452, for example, while addresses A2 to A7 associated with drop generators 150 may be addressed during every firing period 452, which means the recirculation pump has a duty cycle of 50% while drop generators 150 have a 100% duty cycle. In this fashion, different duty cycles can be provided for any number of different primitive functions.

Embedding address bits in an address data portion 320 of print data packet 310, in lieu of hardcoding predetermined addresses in a predetermined order, as is done by address generator 200 of primitive drive and control logic circuitry 190, provides selective primitive functions to be added to the print data stream (e.g. selective addressability of firing sequence of ink ejection events, and recirculation events). Embedding of address bits in an address data portion 320 of print data packet 310 also enables a primitive function to be addressable with multiple addresses, wherein the primitive function responds in a different fashion to each of the multiple addresses.

Figure 11:
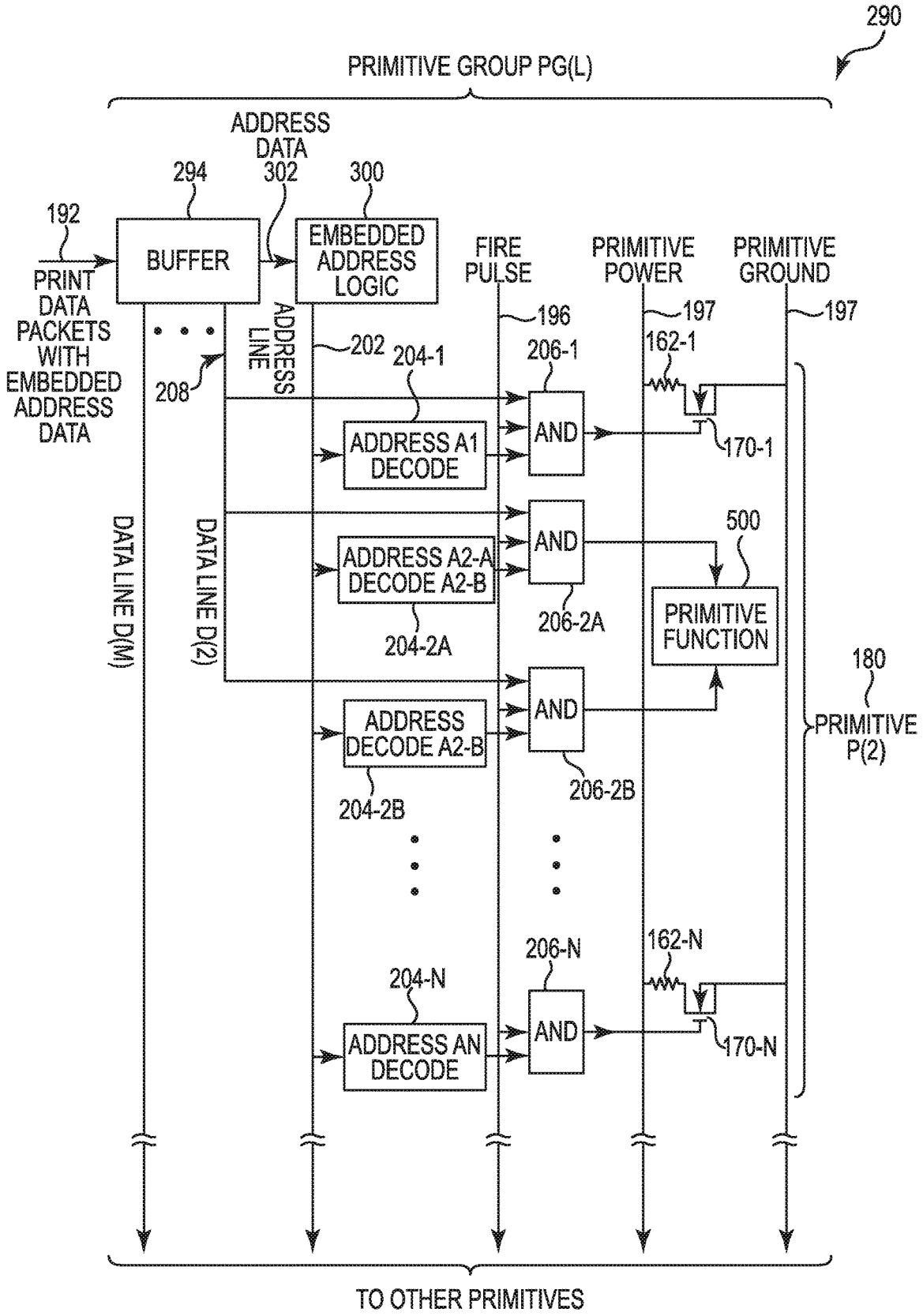
FIG. 11 is a block and schematic diagram illustrating portions of primitive drive and logic circuitry according to one example.

FIG. 11 is block and schematic diagram illustrating portions of primitive drive and logic circuitry 290, which is modified from that shown in FIG. 7, so as to include a primitive function 500 which corresponds to multiple addresses, according to one example. In the illustrated example, a pair of address decoders 204-2A and 204-2*b*, and a pair of AND-gates 206-2A and 206-2B correspond to primitive function 500. Address decoder 206-2A is configured to decode both address A2-A and address A2-B, and address decoder 206-2B is configured to decode only address A2-B.

In operation, if address A2-A is present on address line 202, address decoder 204-2A provides an active signal to AND-gate 206-2A. If data is present on data line D(2) and a fire pulse is present on line 196, AND-gate 206-2A provides an active signal to primitive function 500 which, in-turn, provides a first response. If address A2-B is present on address line 202, address decoder 204-2A provides an active signal to AND-gate 206-2A, and address decoder 204-2B provides an active signal to AND-gate 206-2B. If data is present on data line D(2) and a fire pulse is present on line 196, both AND-gate 206-2A and AND-gate 206-2B provide active signals to primitive functions 500 which, in-turn, provides a second response. As such, primitive function 500 can be configured to respond differently to each corresponding address.

Figure 12:
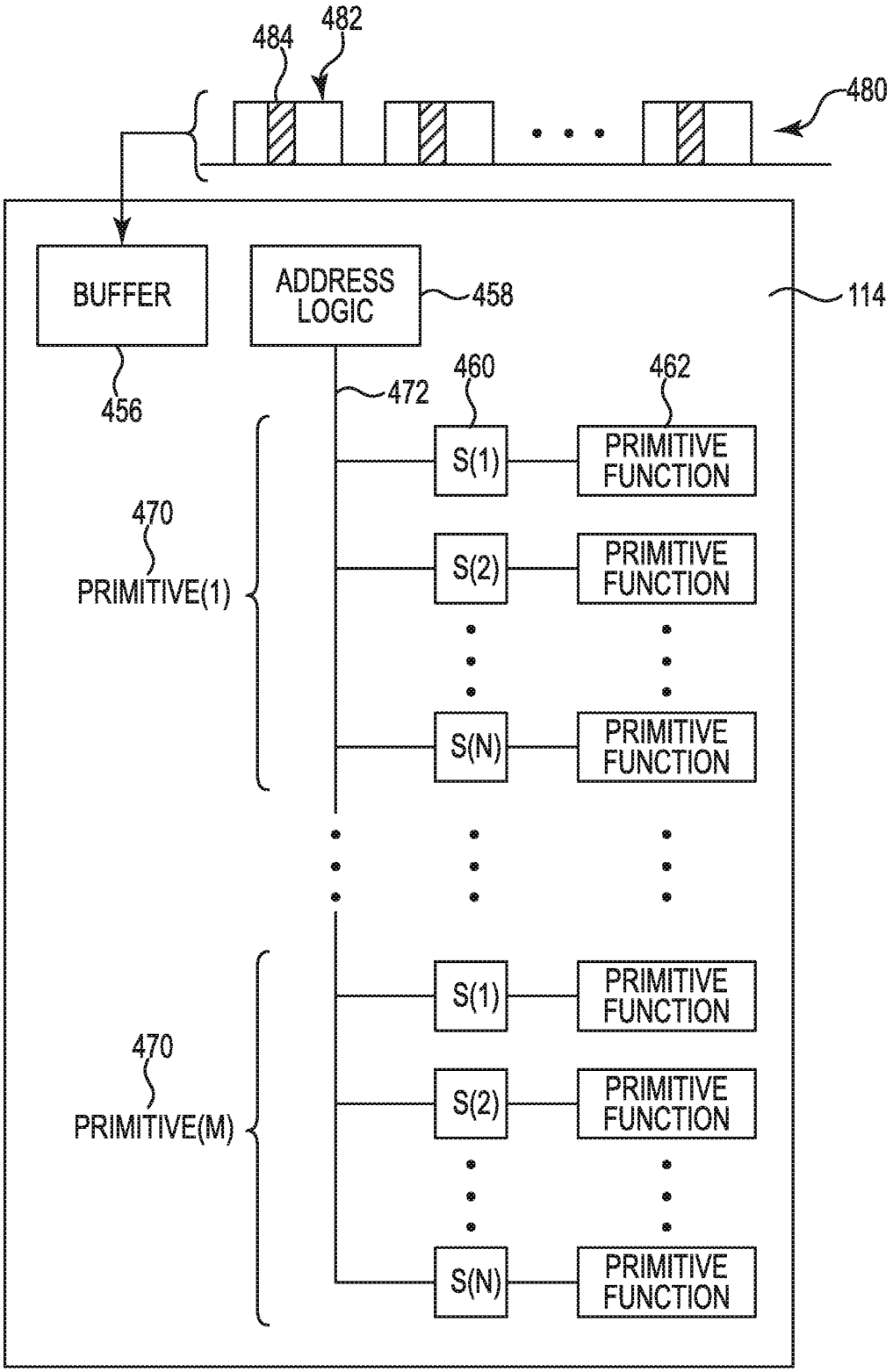
FIG. 12 is block and schematic diagram illustrating generally a printhead according to one example.

FIG. 12 is a block and schematic diagram illustrating generally a printhead 114 according to one example of the present disclosure. Printhead 114 includes a buffer 456, address logic 458, and a plurality of controllable switches, as illustrated by controllable switch 460, with each controllable switch 460 corresponding to a primitive function 462. The controllable switches 460 are arranged into a number of primitives 470, with each primitive 470 having a same set of addresses, each address corresponding to one of the number of primitive functions 462 and each controllable switch of a primitive corresponding to at least one address of the set of addresses. A same data line 472 is coupled to each controllable switch 460 of each primitive 470.

Buffer 456 receives a series of data packets 480, with each data packet 482 including address bits 484 representative of one address of the set of addresses. Address logic 458 receives the address bits 484 of each data packet 482 from the buffer 456 and for each data packet 482 encodes the address represented by the address bits 484 onto address line 472, wherein the at least one controllable switch 460 corresponding to the address encoded on address line 472 activates the corresponding primitive function 462 (e.g. ejecting an ink drop from a drop generator).

Figure 13:
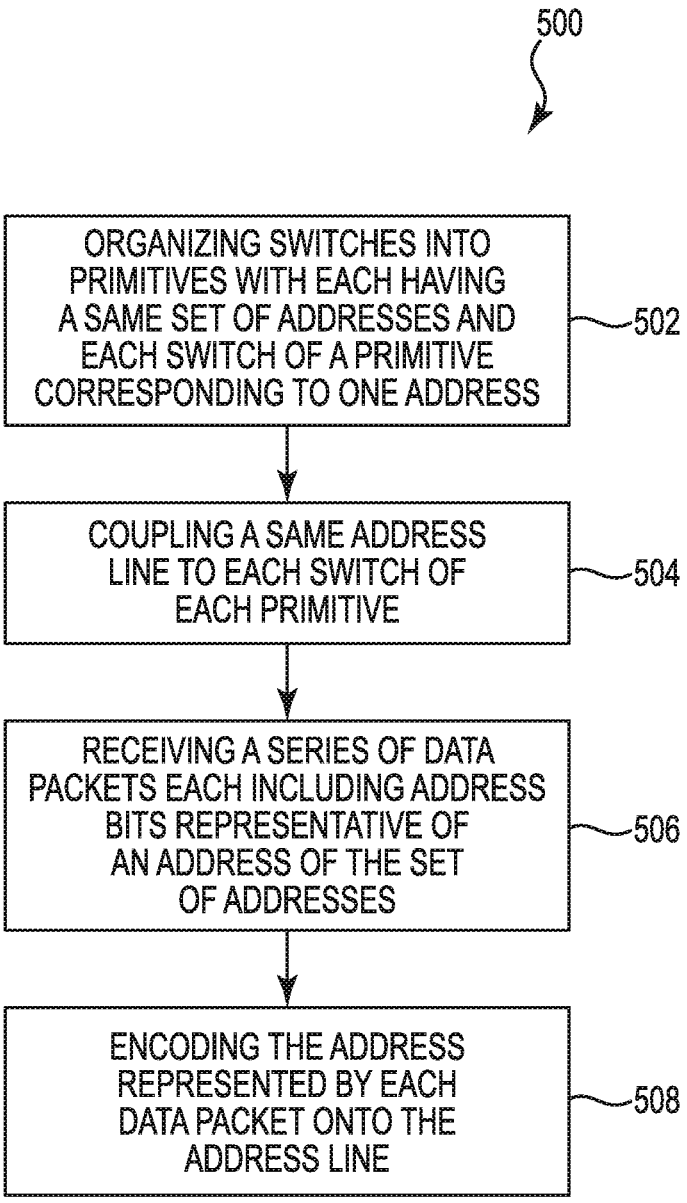
FIG. 13 is a flow diagram of a method of operating a printhead, according to one example.

FIG. 13 is a flow diagram illustrating generally a method 500 of operating a printhead, such as printhead 114 of FIGS. 7 and 12. At 502, method 500 includes organizing a plurality of controllable switches on the printhead into a number of primitives, wherein each primitive has a same set of addresses, with each address corresponding to one of a number of primitive functions, and each controllable switch of a primitive corresponding to at least one address of the set of addresses. At 504, a same address line on the printhead is coupled to each controllable switch of each primitive.

At 506, the method includes receiving a series of data packets, with each data packet including address bits representative of one address of the set of addresses. At 508, for each data packet, the method includes encoding the address represented by the address bits onto the address line.

Although specific examples have been illustrated and described herein, a variety of alternate and/or equivalent implementations may be substituted for the specific examples shown and described without departing from the scope of the present disclosure. This application is intended to cover any adaptations or variations of the specific examples discussed herein. Therefore, it is intended that this disclosure be limited only by the claims and the equivalents thereof.

The invention claimed is:

1. A printhead comprising:

an address line to communicate a set of addresses;

a number of activation devices arranged to form a number of primitives, for each primitive, the activation devices addressable by the set of addresses via the address line with each activation device corresponding to a different address of the set of addresses;

a set of data lines, each data line of the set of data lines corresponding to a different one of the primitives; and control logic to:

receive data packets, each data packet including address data representative of an address of the set of addresses and print data for each primitive;

place the print data for each primitive on the corresponding data line; and encode the address represented by the address data onto the address line.

2. The printhead of claim 1, the control logic to encode addresses on the address line in an order in which the address data is received via the data packets such that some addresses of the set of addresses may be encoded onto the address line more frequently than other addresses of the set of addresses.

3. The printhead of claim 1, including:

a fire pulse line to communicate a fire pulse;

for each primitive, the activation device corresponding to the address bus on the address bus to activate based on the print data on the corresponding data line when a fire pulse is present on the fire pulse line.

4. The printhead of claim 1, a first group of activation devices of each primitive addressable by a first group of addresses of the set of address, each activation device of the first group having a corresponding drop generator to eject a fluid drop having a first drop size, for each primitive, the activation device of the first group corresponding to the address on the address line to activate the corresponding drop generator based on print data on the corresponding data line.

5. The printhead of claim 4, a second group of activation devices of each primitive addressable by a second group of addresses of the set of addresses different from the first group of addresses, each activation device of the second group having a corresponding drop generator to eject a fluid drop having a second drop size different from the first drop size.

6. A fluid ejection device comprising:

an address line; and control logic to:

receive data packets, each data packet including address data representative of an address of a set of addresses; and for each data packet encode the address represented by the address data onto the address line.

7. The fluid ejection device of claim 6, the control logic to encode addresses of the set of addresses onto the address line in the order in which the addresses are received via the data packets.

8. The fluid ejection device of claim 7, the control logic to encode addresses onto the address line in a non-fixed order.

9. The fluid ejection device of claim 6, including:

a set of data lines; and a number of primitives, each primitive including a number of activation devices addressable by the set of addresses, each activation device corresponding to at least one address of the set of addresses, and each primitive corresponding to a different one of the data lines of the set of data lines;

each data packet including print data for each primitive, for each data packet, the control logic to place the print data for each primitive on the corresponding data line.

10. The fluid ejection device of claim 9, including a fire pulse line to communicate a fire pulse;

for each primitive, the activation device corresponding to the address on the address line to activate based on the print data on the corresponding data line in response to a fire pulse on the fire pulse line.

11. The fluid ejection device of claim 9, a first group of activation devices of each primitive addressable by a first group of addresses of the set of address, each activation device of the first group having a corresponding drop generator to eject a fluid drop having a first drop size, for each primitive, the activation device of the first group corresponding to the address on the address line to activate the corresponding drop generator based on print data on the corresponding data line.

12. The fluid ejection device of claim 11, a second group of activation devices of each primitive addressable by a second group of addresses of the set of addresses different from the first group of addresses, each activation device of the second group having a corresponding drop generator to eject a fluid drop having a second drop size different from the first drop size.

13. A fluidic die comprising:

an address line to communicate a set of addresses;

a set of data lines;

a plurality of primitives, each primitive corresponding to a different data line of the set of data lines and including a plurality of activation devices addressable by the set of addresses, each activation device corresponding to a different address of the set of addresses;

address logic; and a buffer to:

receive a series of data packets, each data packet including address data representative of an address of the set off addresses and print data for each primitive; and for each data packet, to:

place the print data on the respective data lines; and direct the address data to the address logic;

the address logic to encode the address data onto the address line.

14. The fluidic die of claim 13, the address logic to encode addresses onto the address line in the order in which the addresses are received via the data packets by the buffer such that the address logic encodes the addresses onto the address line in a non-fixed order.

15. The fluidic die of claim 13, including:

a fire pulse line to communicate a fire pulse;

for each primitive, the activation device corresponding to the address bus on the address bus to activate based on the print data on the corresponding data line when a fire pulse is present on the fire pulse line.

16. The fluidic die of claim 13, a first group of activation devices of each primitive addressable by a first group of addresses of the set of address, each activation device of the first group having a corresponding drop generator to eject a fluid drop having a first drop size, for each primitive, the activation device of the first group corresponding to the address on the address line to activate the corresponding drop generator based on print data on the corresponding data line.

17. The fluidic die of claim 16, a second group of activation devices of each primitive addressable by a second group of addresses of the set of addresses different from the first group of addresses, each activation device of the second group having a corresponding drop generator to eject a fluid drop having a second drop size different from the first drop size.

* * * * *